US005713147A

United States Patent [19]

Johnson

[11] Patent Number: 5,713,147

[45] Date of Patent: Feb. 3, 1998

[54] ORNAMENTAL PHOTOGRAPH HOLDER

[76] Inventor: Maria Ward Johnson, 3 Lynwood Ave., Toronto, Ontario, Canada, M4V1K3

[21] Appl. No.: 653,029

[22] Filed: May 24, 1996

[51] Int. Cl.[6] ..... G09F 1/12

[52] U.S. Cl. ..... 40/771; 40/734

[58] Field of Search ..... 40/734, 737, 771, 40/661; 63/19

[56] References Cited

U.S. PATENT DOCUMENTS

| | | | |
|---|---|---|---|
| 152,197 | 6/1874 | Wachter . | |
| 368,984 | 8/1887 | Vollmer . | |
| 736,751 | 8/1903 | Lobmiller . | |
| 1,061,364 | 5/1913 | Ewing | 63/19 |
| 1,701,610 | 2/1929 | Forstner . | |
| 2,262,548 | 11/1941 | Genser | 63/19 |
| 2,288,732 | 7/1942 | Nickerson | 40/734 |
| 2,863,307 | 12/1958 | Donle | 63/19 |
| 3,579,887 | 5/1971 | Rochelt . | |
| 3,802,104 | 4/1974 | Wiley . | |
| 4,224,364 | 9/1980 | Hunt | 40/734 X |
| 4,343,104 | 8/1982 | Szabo . | |
| 4,581,904 | 4/1986 | Lehmann et al. | 63/19 X |
| 4,882,915 | 11/1989 | Porcaro | 63/19 |
| 4,984,683 | 1/1991 | Eller | 63/19 X |

FOREIGN PATENT DOCUMENTS

| | | |
|---|---|---|
| 104724 | 2/1907 | Canada . |
| 192266 | 8/1919 | Canada . |
| 200361 | 5/1920 | Canada . |
| 266351 | 11/1926 | Canada . |
| 823395 | 9/1969 | Canada . |
| 1335474 | 5/1995 | Canada . |

*Primary Examiner*—Joanne Silbermann
*Attorney, Agent, or Firm*—Ezra Sutton

[57] ABSTRACT

A transparent globular photograph holder is provided herein. The holder consists of a pair of transparent semiglobular members—each such complementary transparent member consisting of a hollow semiglobe having a flat, planar, circular face, said flat, planar, circular face constituting an inner frame disc. Each such inner frame disc consists of an integrally-formed inner circular ring for co-operating together to provide back-up rings for holding two photographs, back-to-back, for two-way viewing. The hollow semiglobes are being selectively secured together at a selected area of their respective flat, planar, circular faces by hinge means. They also are releaseably temporarily locked together at another area of their respective flat, planar, circular faces by means of a flexible clasp on one of said inner frame discs which co-operates with a retaining slot in said other inner frame disc: means are provided for hanging the transparent globular photograph holder.

7 Claims, 3 Drawing Sheets

ORNAMENTAL PHOTOGRAPH HOLDER

BACKGROUND OF THE INVENTION (i) Field of the Invention

This invention relates to an ornamental photograph holder.

(ii) Description of the Prior Art

There are presently available a variety of frames or frame assemblies for mounting pictures, photographs and the like. Heretofore, frames generally fell into two categories, namely frames of the type adapted for mounting upon a wall and frames adapted for being supported upon a suitable horizontal surface, e.g., tables, desks and the like. Conventional frames are normally comprised of a rectangular or square-shaped frame for framing the picture or photograph and a rigid backing member and a transparent member. The transparent member is inserted in the frame with the picture or photograph mounted between the backing and the transparent member with the rigid backing affixedly-secured to the frame to mount the picture firmly between the transparent member and the backing member. Additional means are usually provided on the rear of the rigid backing member (for example, a wire) for support upon a picture hook or other like wall-mounting device.

Desk or table frames are usually similar in nature to the frames described above, but are further provided with a hinged support member which is secured to the rear of the rigid backing member in order to support the frame assembly upon a horizontal surface normally with the orientation of the frame being diagonal relative to the support surface.

Photographs may also be displayed in pieces of jewellery. The flat locket with a transparent cover was one example of the prior art.

Another example has been the conventional practice of placing photos in a plurality of holders which were joined together by hinge means. In some instances, the holders may be folded over upon themselves for storage purposes. In other instances, a separate enclosure or housing for storing the pictures was provided. When manufactured or constructed in miniature, the housing could be a form of jewellery which was pinned or suspended from the neck or clothing of the user. Therefore, such an article was useful both for its ornamental value and for its use for storing the plurality the plurality of photos when not being viewed.

The patent literature also provided some photograph holders.

Canadian Patent No. 104,724 patented Apr. 16, 1907 by A. V. Mountford, provided a jewellery receptacle comprising a plate having a curled up spring edge with a notch formed therein. A cover having a projection with latterly-extending portions was designed to fit into holes in the curled edge at each end of the notch. Preferably also a shank or handle was attached to the cover and was designed to form a means for manipulating the cover.

Canadian Patent No. 192,266 patented Aug. 26, 1919 by E. Carlson, provided a locket comprising a casing having an absorbing pad removably-mounted therein. A retaining ring was mounted within the casing and snugly-fit in engagement with the inner wall thereof. The retaining ring was inclined inwardly with the casing along its inner periphery. The inner edge of the ring firmly engaged the absorbing pad for detachably holding the pad within the casing. A closure cover was provided for the casing.

Canadian Patent No. 200,361 patented May 25, 1920 by A. Vericel, provided a vanity case which included a pair of covers, each of which was formed with a substantially-circular receptacle. An elongated receptacle was exteriorly arranged with respect to the circular receptacle. Means were carried by the elongated receptacle for hingedly-securing the covers together. A mirror was hingedly-secured between the covers.

Canadian Patent No. 266,351 patented Dec. 15, 1927 by L. S. Chilson provided a locket-type ornament which included a background member formed of mother-of-pearl, and a protecting lens. Means secured the lens and the background member together. Feathers were secured to the surface of the background member beneath the lens, the feathers being arranged in simulation of a bird. The background had an iridescence imparting a depth effect simulating the appearance of the sky.

Canadian Patent No. 823,395 issued Sep. 23, 1969 to E. Handler et at, provided a child's locket. Such locket had a figure toy removably insertable therein and was adapted to be worn as a brooch, a hairpiece ornament, a belt, a pendant, or a pocket ornament, or could be used as a table-top ornament. The locket included a first member formed of transparent material, the first member having a predetermined shape thereto defining a cavity having a mouth. A second member was provided with aperture means. Means pivotally-secured the second member to the first member for covering the mouth. A three-dimensional object was removably insertable within the cavity in the first member, with the aperture means accommodating a portion of that object. That portion extended into a plane lying beyond the plane of the second member and away from the first member. Means were provided for supporting the first member in a position to be observed for viewing the object through the transparent material.

Canadian Patent No. 1,335,474 issued May 9, 1995 to K. Bulmer et al provided a three-dimensional display case. The exterior of the display case was a frame with inner and outer face dimensions that produces an angle of depth and forms a lip on rear of frame. A transparent front plate is attached to such lip. The interior of the display consists of a hollow-type background forming a support for mounting articles. Once the transparent front plate has been secured to the lip of the frame the objects may be viewed therein and protection is provided to the display within. An illumination means is also provided.

U.S. Pat. No. 152,197 issued Jun. 16, 1874 to Wachter, provided a locket having a hinged cover.

U.S. Pat. No. 368,984 dated Aug. 30, 1887 by H. Vollmer, provided a locket which was formed of two hemispherical sections which were rotatable one within the other and which were provided with a lock.

U.S. Pat. No. 736,751 issued Aug. 18, 1903 to Lobmiller, provided a sealed paper weight having a transparent surface enclosing a cavity for housing objects therein.

U.S. Pat. No. 1,701,610 issued Feb. 12, 1929 to Forstner, illustrated an item of jewellery comprising a bracelet incorporating a plurality of links, each having transparent front members through which may be viewed picture cards.

U.S. Pat. No. 2,262,548 patented Nov. 11, 1941 by M. Genser, provided a locket comprising a pair of body sections, with means to hinge the sections together at a point out of line with the lower edges of sections when swung from closed to open position. A leg extended from one section to provide a third point of support with the lower edges of the sections.

U.S. Pat. No. 3,579,887 patented May 25, 1971 by G. Rochelt provided a frame for pictures comprised of a transparent member having a parallelepiped configuration and a lightweight supporting member having a much smaller total mass and weight than the transparent member and having a planar forward surface. The supporting member positioned and framed the transparent member on two opposite parallel sides while framing the picture inserted within the support member on all four sides so as completely to conceal the sides of the picture when the frame was fully assembled. The support member was further provided with a recess along the rear surface to facilitate hanging of the frame upon a wall or other surface. It was further provided with a diagonally-aligned support surface which, together with the disposition of the center of gravity of the assembled frame, enabled the frame to be supported diagonally relative to a support surface upon any of the diagonally-aligned surfaces of the support member. In addition, the two opposite parallel sides of the support member which embraced the transparent member as well as the two exposed sides of the transparent member could be employed as supporting surfaces for supporting the frame assembly in a vertically-aligned fashion upon a suitable supporting surface.

U.S. Pat. No. 3,802,104 patented Apr. 9, 1974 by Rosemary C. Wiley, provided a spherical ball picture viewing device, in the form of a plurality of spherical transparent balls, each having a flattened face portion along one side thereof. A picture was embedded into one side face portion of each ball. The face of the picture had pictorial matter thereon directed toward the center axis of the transparent ball, so that the picture was magnified when viewed from the face of the ball opposite the flattened face portion. A wire was embedded into each ball, and the wire of the balls were connected together to form a grape-like cluster.

U.S. Pat. No. 4,343,104 patented Aug. 10, 1982 by A. Szabo provided an ornamental design for the display of photographs. This design had a bifurcated body with base members connected by a hinge. A recess in the body was formed by overlaying edges on these members. A filigree cover was integrally carried by one member, but it was releasably-secured to the other member. As a result, the cover was released and the members folded rearwardly to permit the article to be displayed, to be inserted or to be removed from the recess.

U.S. Pat. No. 4,882,915 patented Nov. 28, 1989 by E. L. Porcaro provided a combined locket and photo holder having a separable housing which was positionable into a first open position and a second closed position. A plurality of photo holders were hingedly-connected together so as to extend in side-by-side relationship from the housing when the housing was separated and to fold over upon themselves for storage inside the housing when the housing was in its second closed position. A releasable clamp secured the housing together when in its second closed position. A carrying chain was employed from which the housing downwardly-depended. Each photo holder was centrally recessed to receive and mount a picture.

None of the above patents describe a clear transparent round globular hangable ornament which is designed to hold photographs.

SUMMARY OF THE INVENTION (i) Aims of the Invention

An object of the present invention is to provide a clear transparent globular hangable ornament having a housing having means for securing at least one photograph therein.

Another object of this invention is to provide such an ornament that may be readily manipulated to an open position so that photographs may be replaced.

Another object of the present invention is to provide such an ornament having a plurality of photo holders.

Yet another object of the present invention is to provide such an ornament having a plurality of photo holders which also includes clamp means for holding the housing closed.

Another object of the present invention is to provide a novel article of manufacture that may be composed of a lightweight material, e.g., plastic.

Another object of the present invention is to provide a novel article of manufacture which is relatively light in weight and is relatively smooth so that all its surfaces are coextensive to avoid projection, extension or protruding members which would normally snag or catch.

Still a further object of the present invention is to provide such an ornament having a housing for holding a plurality of photos wherein the individual photo is held in a recessed location.

Another object of the present invention is to provide such an ornament including a novel frame assembly for photographs, pictures and the like which is designed to be hung, e.g., on a Christmas tree.

Another object of the present invention is to provide a novel two-piece frame assembly for use in mounting pictures, photographs and the like and being comprised of a support member embracing a solid transparent member in such a manner as to facilitated simple removal and replacement of the picture and transparent manner.

(ii) Statement of Invention

By the present invention, a transparent globular photograph holder is provided consisting of two transparent complementary semiglobular members, each such complementary transparent member consisting of a hollow semiglobe having a flat, planar, circular face, such flat, planar, circular face constituting an inner frame disc, each such inner frame disc consisting of an integrally-formed, inner circular ring for co-operating together to provide back-up rings for holding two photographs, back-to-back, for two-way viewing, such hollow semiglobes being selectively-secured together at a selected area of their respective flat, planar, circular faces by hinge means, and being releasably temporarily locked together at another area of their respective flat, planar, circular faces by means of a flexible clasp on one of the inner frame discs which co-operates with a retaining slot in the other inner frame disc; and means for hanging the transparent globular photograph holder.

(iii) Other Features of the Invention

By specific features of this invention, the inner frame discs may be integrally-held together by a living hinge, or may be separate inner frame discs but which are held together by hinge means, e.g., a male hinge on one inner frame disc and a female hinge on the other inner frame disc. By other specific features of this invention, the discs are provided with the holding means in the form of ring-like recesses for supporting the photograph.

By yet another feature of this invention, the transparent globular photograph holder is formed of injection-molded high impact polystyrene.

By another feature of this invention, the transparent semiglobular members are integrally injection molded, and preferably the inner frame discs are integrally held together by a living hinge which is integrally formed by that injection molding.

By yet a further feature of this invention, the means for hanging comprises two tabs, one tab extending radially outwardly from each inner frame disc, one such tab including an aperture therethrough, and the other such tab having a mating aperture therethrough.

BRIEF DESCRIPTION OF THE DRAWINGS

In the accompanying drawings.

DESCRIPTION OF PREFERRED EMBODIMENTS (i) Description of FIGS. 1–5

Figure 1:
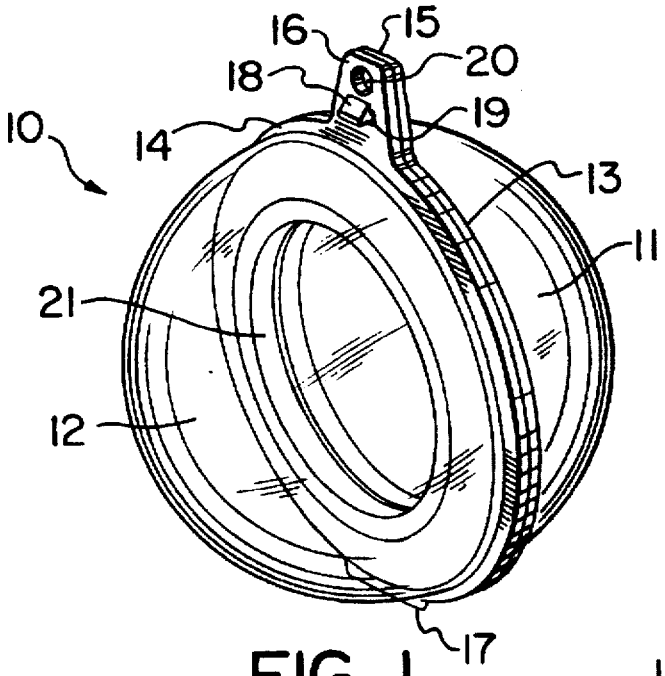
FIG. 1 is a perspective view of the ornamental photograph holder of one embodiment of the present invention, including FIG. 1A which is an enlarged view of the clasp.
Figure 1A:
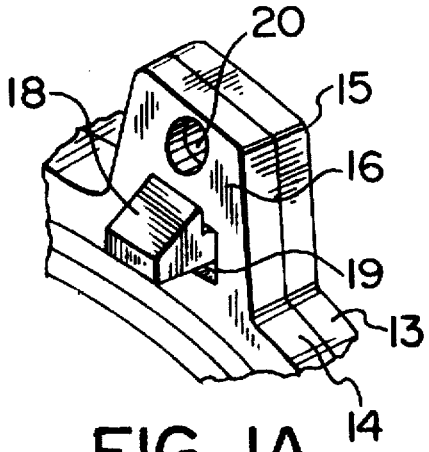
Figure 2:
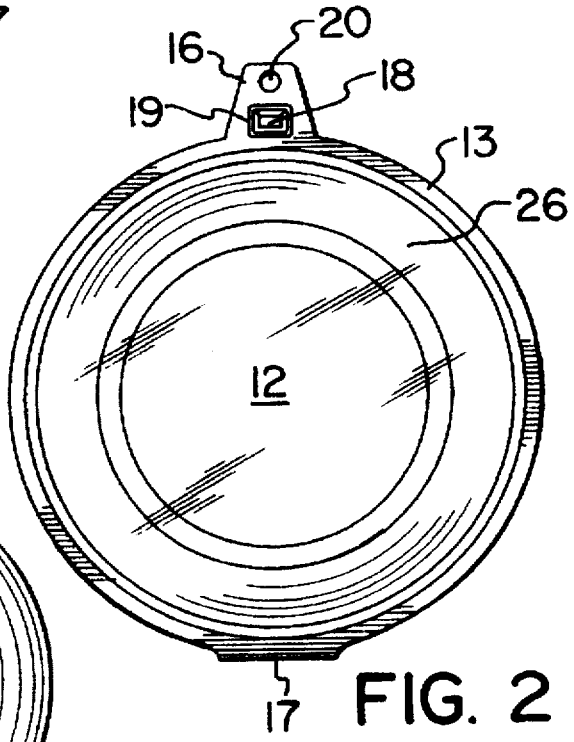
FIG. 2 is a front elevational view thereof in its open condition.
Figure 3:
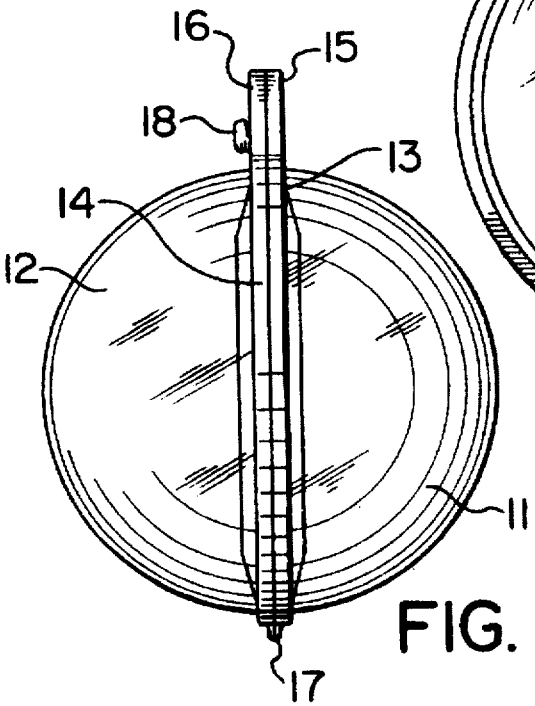
FIG. 3 is a side elevational view thereof.
Figure 4:
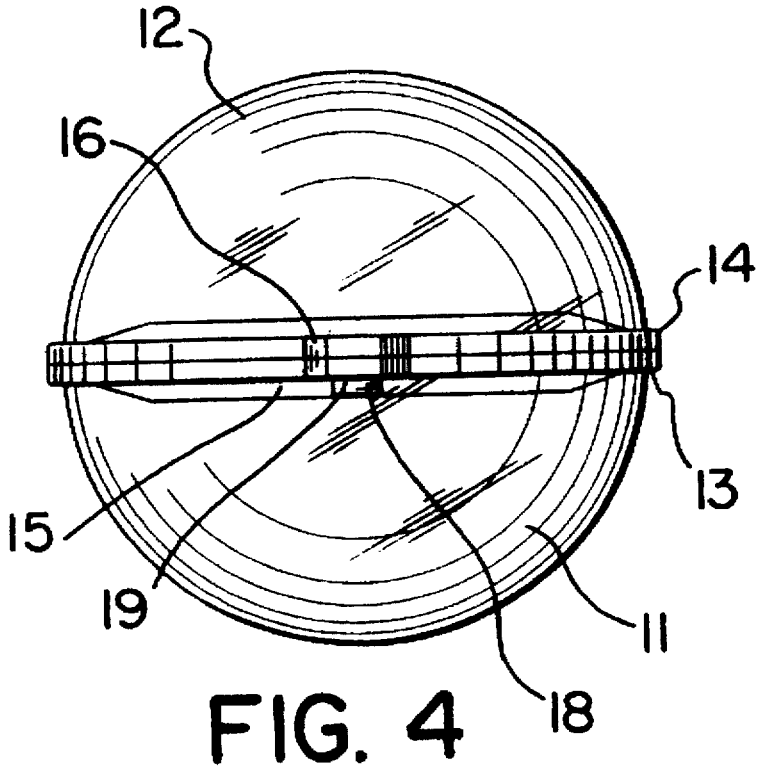
FIG. 4 is a top plan view thereof.
Figure 5:
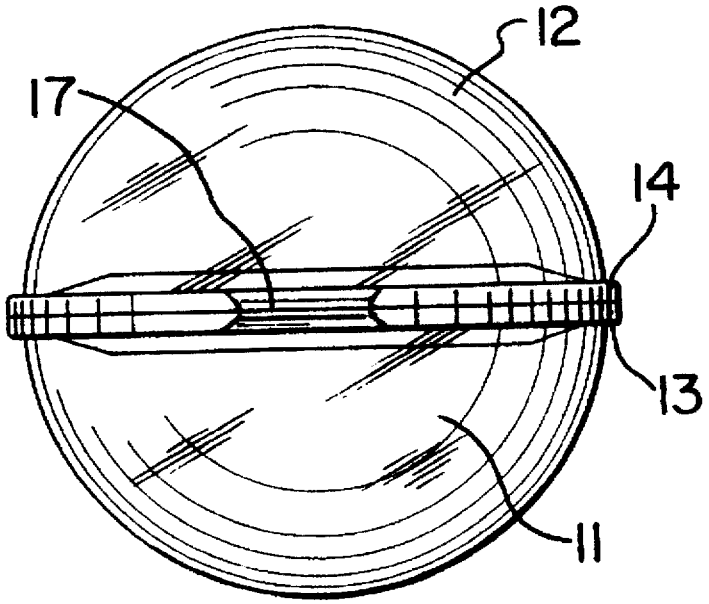
FIG. 5 is a bottom plan view thereof.

As seen in FIGS. 1 and 2, the ornamental photograph holder 10 consists of two transparent half globular member 11, 12, each half 11, 12 being integrally-formed with its associated decorative circular frame disc 13, 14, 15, 16. In its closed position, the members are hinged together by means of a living hinge 17 and are held in closed position at clasp tabs 15, 16 by a flexible band 18 on one member engaging retaining slot 19 on the other member. Clasp tabs 15, 16 also include a hanging aperture 20.

FIG. 2 shows the cooperation of one of the discs—or ring-shaped recesses 26 by means of which a pair of framed photographs are held, back to back, between frame discs 14, 15, as will be described hereinafter.

Figure 6:
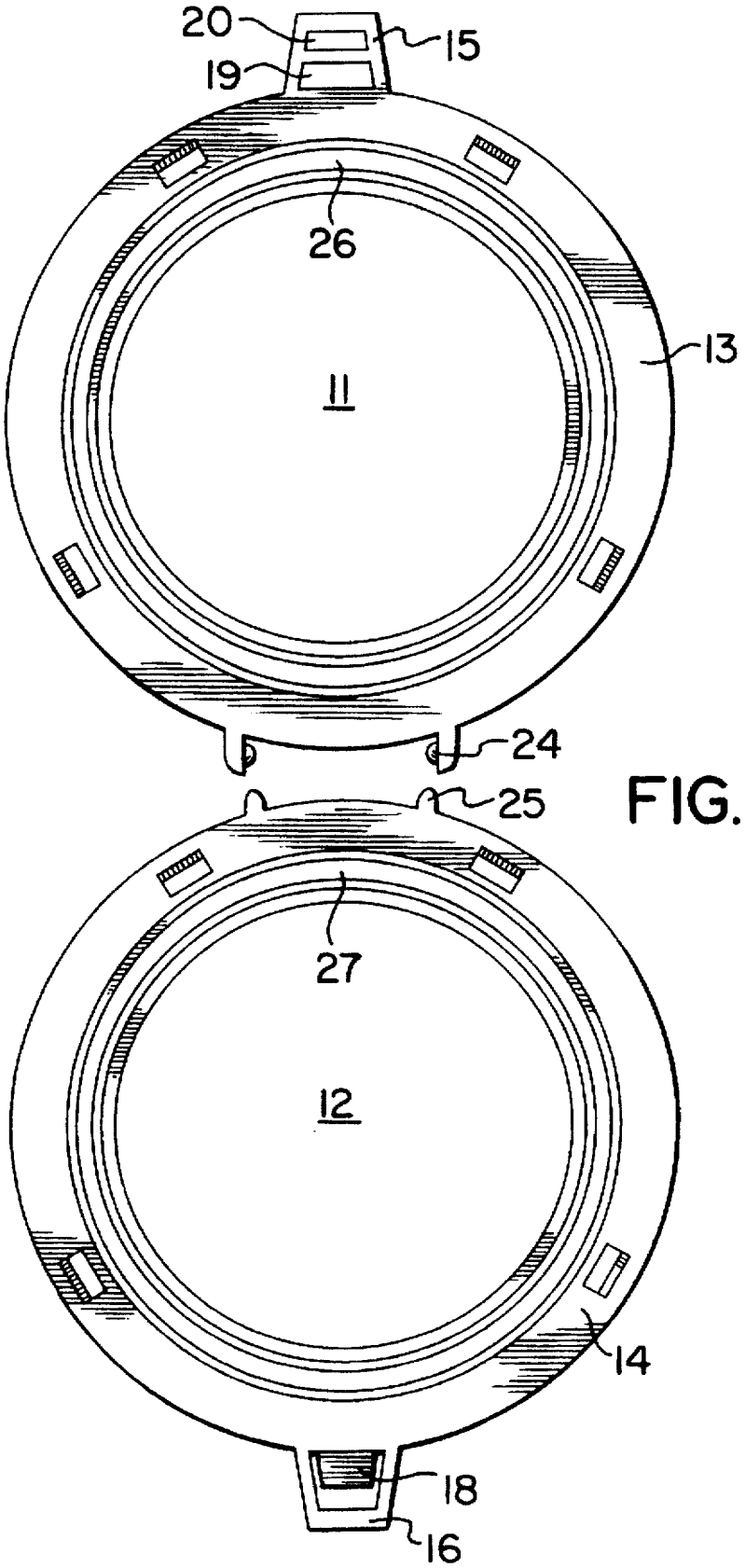
FIG. 6 is a front elevational view of another embodiment of the present invention in its open condition.

(ii) Description of FIG. 6

FIG. 6 shows another embodiment of the invention in which two separate frame discs 11, 12 are held together by male hinge member 24 cooperating with female hinge member 25.

FIG. 6 also shows the cooperating disc-shaped recesses 26, 27 by means of which a trimmed photograph is held or two trimmed photographs are held back-to-back between frame discs 13, 14 by being inset into the respective recesses.

In respect of both embodiments of the invention, it is preferred that the outer sphere halves 11, 12 and the inner frame discs 13, 14 be injection-molded out of high-impact polystyrene.

OPERATION OF PREFERRED EMBODIMENT

In a typical embodiment, two photographs are trimmed to a circular shape and are placed back-to-back into the co-operating, disc-shaped recesses. Closing of the outer sphere halves traps the photographs for two-way viewing. The hanging aperture is also used for suspending the ornamental photograph holder.

CONCLUSION

Thus, as described herein, the ornamental photograph holder is a clear, round, plastic tree ornamental designed to hold two photographs back-to-back. A decorative circular "frame" is integral to the ornament.

From the foregoing description, one skilled in the art can easily ascertain the essential characteristics of this invention and, without departing from the spirit and scope thereof, can make various changes and modifications of the invention to adapt it to various usages and conditions. Consequently, such changes and modifications are properly, equitably, and "intended" to be, within the full range of equivalence of the following claims.

I claim:

1. A transparent globular photograph holder consisting of: two transparent complementary semiglobular members, each said complementary transparent member consisting of a hollow semiglobe having a flat, planar, circular face, said flat, planar, circular face constituting an inner frame disc, each said inner frame disc consisting of an integrally-formed inner circular ring for co-operating together to provide back-up rings for holding two photographs, back-to-back, for two-way viewing, said hollow semiglobes being selectively-secured together at a selected area of their respective flat, planar, circular faces by hinge means, and being releasably temporarily locked together at another area of their respective flat, planar, circular faces by means of a flexible clasp on one of said inner frame discs which co-operates with a retaining slot in said other inner frame disc; and means for hanging said transparent globular photograph holder.

2. The transparent globular photograph holder of claim 1 wherein said hinge means is a living hinge.

3. The transparent globular photograph holder of claim 1 wherein said hinge means comprising a male hinge on one said inner frame disc and a female hinge on the other said inner frame disc.

4. The transparent globular photograph holder of claim 1 formed of injection-molded high impact polystrene.

5. The transparent globular photograph holder of claim 1 wherein said transparent semiglobular members are integrally injection molded.

6. The transparent globular photograph holder of claim 5 wherein said inner frame discs are integrally held together by a living hinge which is integrally formed by injection molding.

7. The transparent globular photograph holder of claim 1 wherein said means for hanging comprises two tabs, one tab extending radially outwardly from each said inner frame disc, one said tab including an aperture therethrough, and the other said tab having a mating aperture therethrough.

* * * * *